US007686476B2

(12) United States Patent
Metz et al.

(10) Patent No.: US 7,686,476 B2
(45) Date of Patent: Mar. 30, 2010

(54) LED DOCK LIGHT

(75) Inventors: Donald L. Metz, Kirkville, NY (US); Wendell K. Moulton, Marcellus, NY (US)

(73) Assignee: DL Manufacturing, North Syracuse, NY (US)

( * ) Notice: Subject to any disclaimer, the term of this patent is extended or adjusted under 35 U.S.C. 154(b) by 182 days.

(21) Appl. No.: 11/881,301

(22) Filed: Jul. 26, 2007

(65) Prior Publication Data

US 2009/0027878 A1 Jan. 29, 2009

(51) Int. Cl.
*F21V 29/00* (2006.01)

(52) U.S. Cl. ..... 362/249.04; 362/294; 362/373

(58) Field of Classification Search ..... 362/157, 362/183, 239, 294, 276, 373, 249.04
See application file for complete search history.

(56) References Cited

U.S. PATENT DOCUMENTS 4,109,144 A * 8/1978 Vidmar ..... 362/247
4,586,117 A * 4/1986 Collins ..... 362/373
5,709,458 A 1/1998 Metz
5,746,495 A * 5/1998 Klamm ..... 362/577
5,791,763 A * 8/1998 Kam-Hoi ..... 362/183
6,095,671 A * 8/2000 Hutain ..... 362/373
6,203,180 B1 * 3/2001 Fleischmann ..... 362/471
7,334,918 B2 * 2/2008 Newton et al. ..... 362/239
2005/0168999 A1 8/2005 Sommers et al.

FOREIGN PATENT DOCUMENTS

WO WO-2006017930 2/2006

* cited by examiner

*Primary Examiner*—Stephen F Husar
*Assistant Examiner*—James W Cranson
(74) *Attorney, Agent, or Firm*—Marjama Muldoon Blasiak & Sullivan, LLP

(57) ABSTRACT

A warehouse dock light includes a lamp assembly which is provided with a plurality of LEDs arranged in such a fashion as to collectively provide sufficient light for illumination of an area. The LEDs are arranged in two columns with each column having both LEDs with narrow angle and wide angle lens, and with each column being angled so as to project outwardly from a central axis. Heat from the LEDs is dissipated through bi-metal boards to an extruded aluminum heat sink, and air is blown through the ribs of the heat sink by a fan. A heat sensor is provided with electronic circuitry to responsively turn on the fan and/or turn off the LEDs at predetermined temperature thresholds.

26 Claims, 4 Drawing Sheets

LED DOCK LIGHT

TECHNICAL FIELD

The present invention relates to a dock light and, more particularly, to a dock light with a plurality of LEDs for cooperatively projecting light into the interior of a truck.

BACKGROUND OF THE INVENTION

The use of dock lights on the loading platform of a warehouse for the purpose of illuminating the interior of a truck backed up to the loading platform is well known. Typically, the base of the light is mounted to a wall on the inside of the warehouse to protect the dock light from the elements when not in use, but it includes an extendible linkage for extending the light through the door of a truck so that it can illuminate the interior of the truck.

Such an extendible dock light is disclosed in U.S. Pat. No. 5,709,458 wherein a single halogen lamp is included for obtaining the desired illumination. One disadvantage to the use of halogen lamps is that they are relatively sensitive to damage from impact and can be made inoperable if the surrounding lamp assembly is hit by a door, for example. Further, because of the relative large size of the halogen lamp, the profile of the lamp assembly is relatively large and therefore more likely to be hit by an object.

Another disadvantage to the use of halogen lamps is that, although they use less energy than an incandescent light, they still use a considerable amount of energy to light them. Further, their life is relatively short (i.e. in the range of 2,000 to 5,000 hours).

SUMMARY OF THE INVENTION

In accordance with one aspect of the invention, a dock light is provided with a plurality of LEDs which, in combination, provide the desired illumination when projected into the interior of a truck.

In accordance with another aspect of the invention, the LEDs are mounted in two columns to cooperatively provide a mix of desired projection angles.

By yet another aspect of the invention, the two columns are each angled at an angle of 5° outwardly from a central axis to provide the desired divergence of light.

By another aspect of the invention, each column includes a plurality of high output LEDs with selective lenses, with one LED having a narrow angle lens and the remaining LEDs having a relatively wide angle lens.

In accordance with another aspect of the invention, each of the columns is mounted on a circuit board with the LEDs being connected in series to thereby maintain constant current, and with each having a zener diode connected thereacross to allow continued operation of the remaining LEDs if one should burn out.

In accordance with another aspect of the invention, a heat sensor is mounted on one board and has two set points one to turn on the fan and another to turn off the LEDs.

In the drawings as hereinafter described, a preferred embodiment is depicted; however, various other modifications and alternate constructions can be made thereto without departing from the spirit and scope of the invention.

DETAILED DESCRIPTION OF THE INVENTION

Figure 1:
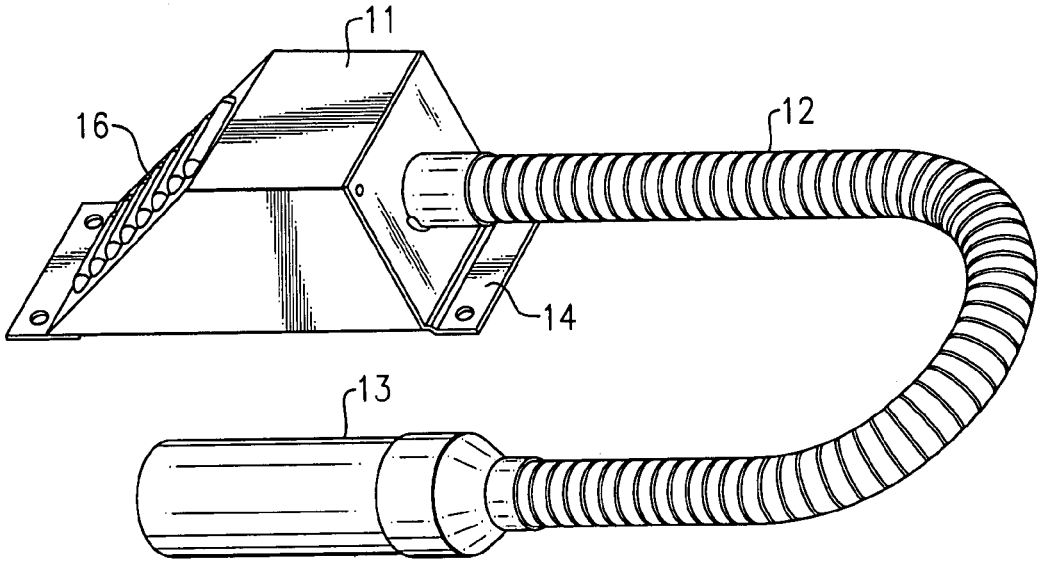
FIG. 1 is a perspective view of a dock light assembly in accordance with the present invention.

The dock light is shown in FIG. 1 to include a housing 11 with an interconnected tube 12 leading to a lamp assembly 13. The housing 11 includes flanges 14 for attachment to the inner wall of a warehouse in such a position that the flexible tube 12 can be extended through a warehouse door opening and into the rear door of a truck which is backed up to the dock for loading or unloading. The lamp assembly 13 is intended for illuminating the inside of the truck during the loading/unloading process.

The housing 11 includes electrical circuitry for connection to a power source. It also includes a fan for drawing air in through the louvers 16, with the airflow then passing down through the flexible tube 12 to the lamp assembly 13 for purposes of cooling the lamp assembly 13. The structure and function of both the housing 11 and the flexible tube 12 is substantially the same as that described in U.S. Pat. No. 5,709,458, assigned to the assignee of the present invention and incorporated herein by reference.

Figure 2:
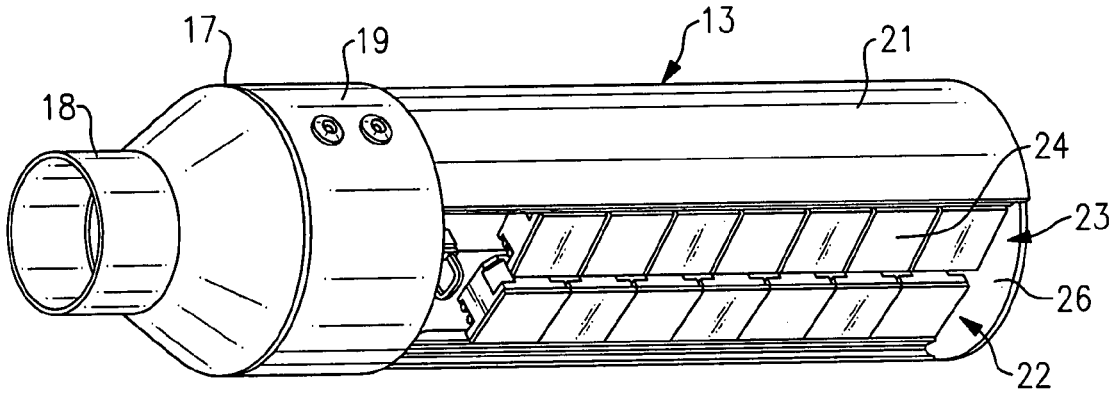
FIG. 2 is a perspective view of the lamp assembly portion thereof.

Referring now to FIG. 2, the lamp assembly 13 is shown to include a reducer 17 having at its one end a small cylinder 18 for attachment to the tube 12 and at its other end a larger cylinder 19 for attachment to a heat sink 21 which is formed in a partial cylinder as shown. Mounted within the heat sink 21 are two columns 22 and 23 of light emitting diodes (LEDs) 24. An end plate 26 is secured at the other end of the lamp assembly 13.

Figure 3:
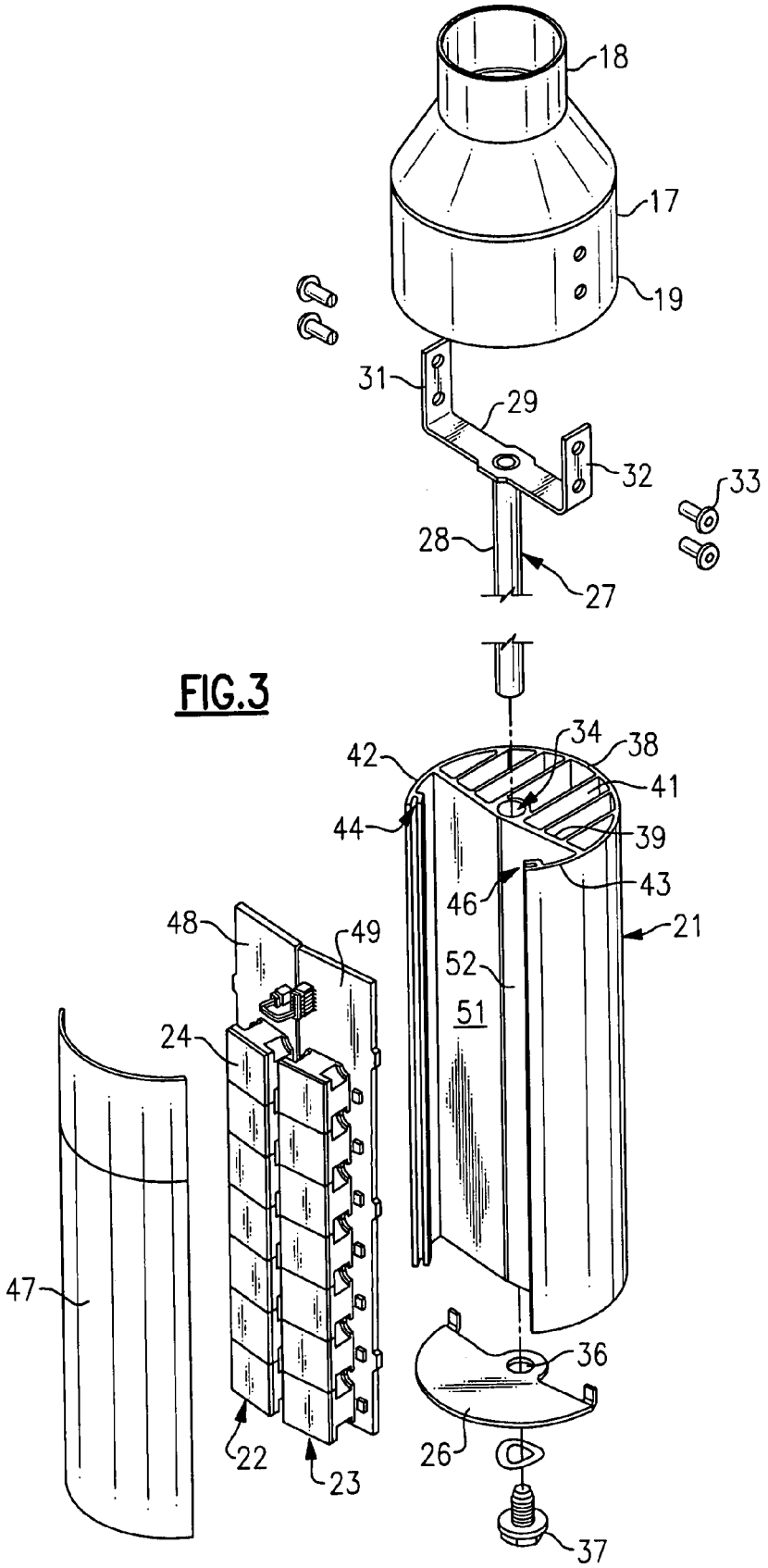
FIG. 3 is an exploded view thereof.
Figure 4:
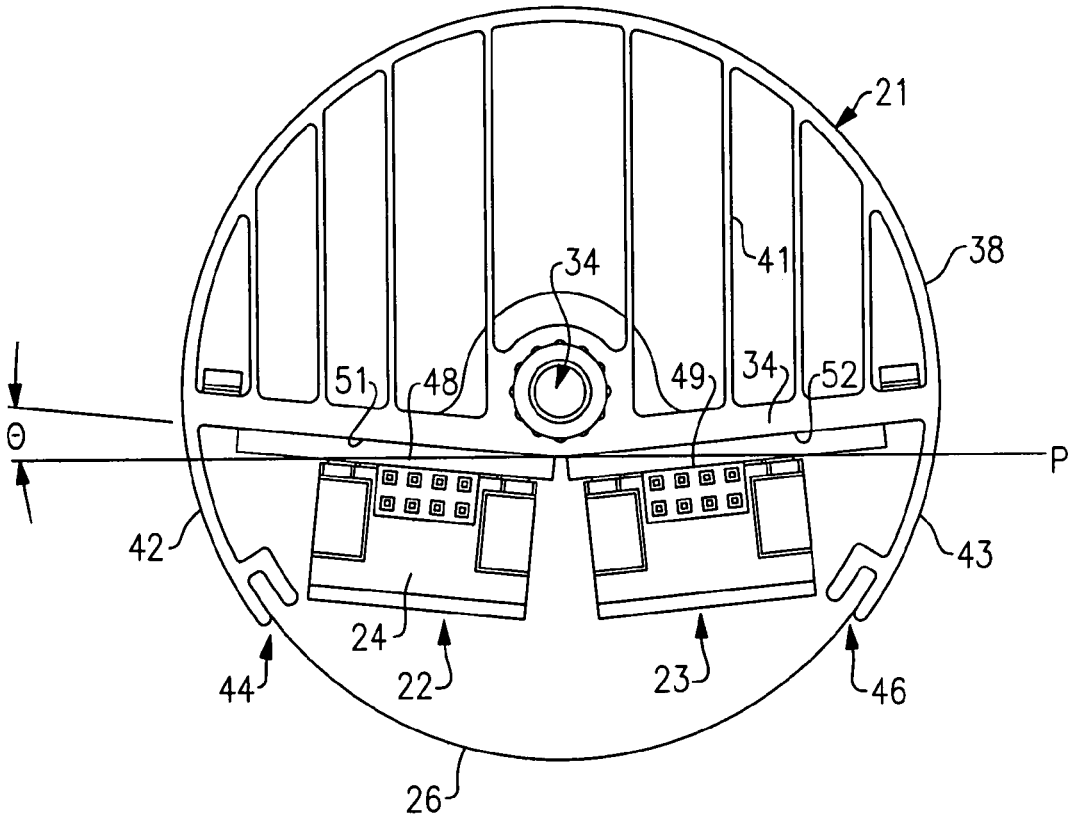
FIG. 4 is an end view of the lamp assembly.

The details of the various components of the lamp assembly 13 can be better seen by reference to FIGS. 3 and 4. As will be seen, the reducer 17, the heat sink 21 and the end plate 26 are interconnected by way of a core member 27 which includes a shaft 28 and a transversely extending side connector 29 fastened at its upper end. The side connector 29 has upstanding side flanges 31 and 32 which are secured to the reducer 17 by rivets 33. The shaft 28 extends downwardly through a core opening 34 of the heat sink 21, through an opening 36 in the end plate 26, with the assembly then being fastened in place by a fastener 37 threadably engaging the lower end of the shaft 28.

The heat sink 21 is a unitary member formed by way of an aluminum extrusion. It includes an outer member 38, a cross member 39 and a plurality of ribs 41 interconnecting the outer member to the cross member as shown. Extending from the interconnection of the outer member 38 and the cross member 39 are a pair of arms 42 and 43 with respective slots 44 and 46 for frictionally receiving the edges of a flexible, polycarbonate cover 47 therein. The cover 47 allows the light to pass therethrough but protects the LEDs 24 from exposure to the elements. The cover 47 may have an anti-reflective coating and can be flexed into place so the light will pass through the cover at close to right angles to minimize reflections.

The two columns 22 and 23 of LEDs are mounted on metal core boards with a dielectric layer (aluminum and ceramic) 48 and 49 by conventional techniques and methods. The bi-metal boards 48 and 49 are, in turn, mounted to the side surfaces 51 and 52 of the cross member 39. The interface between the boards 48 and 49 and the side surfaces 51 and 52, respectively, need to be such that the heat transfer characteristics of the interface are maximized. One approach is to use a double sided, heat transfer thermal tape as the interface. Another approach is to use a heat curing epoxy as the interface. Still another approach would to be use a mechanical fastening means with a heat transfer compound being applied between the boards 48 and 49 and their respective side surfaces 51 and 52.

It will be seen that the structure of the cross member 39 is such that the side surfaces 51 and 52 are angled at an angle Θ from the plane P as shown by the dashed lines. The installed boards 48 and 49 and their attached LED columns 22 and 23 are, of course, also angled in the same manner, such that their projections are at an angle Θ from a central axis C/L. The purpose is to widen the overall illumination effect such that the entire width of the trailer, including the side opposite the dock light assembly, is properly illuminated. Although a wider lens may be applied to each of the LEDs to obtain a wider spread illumination, the resulting diffusion and loss of light will not bring about satisfactory results.

The angle of the diversion between the side surfaces 51 and 52 can be selected to bring about the desired results for any particular application. However, the applicants have found that an angle Θ in the range of 4-6°, or 5°, in particular, has been to be found quite suitable.

The particular type of LED can also be selected to meet the needs of a particular application. A type of LED that the applicants have found to be suitable for each of the fourteen LEDs in columns 22 and 23 is a Cree kit XREWHT-LI-0000-007E4 to XREWHT-LI-0000-008F5 or XREWHT-LI-0000-008E4 with a minimum output of 83 lumens at 0.350 mA. Color is BINS 4A to 4D 4300 to 4750° K. Although the fourteen LEDs are all identical, there respective lens have been varied to obtain the desired illumination within the trailer. That is, in each of the columns, the top three and the bottom three LEDs have a relatively wide angle lens (lens ledil CR square medium order code CRS-M+/−14°). The middle LED in each column, however, is a relatively narrow angle lens (lens ledil CR square smooth spot order code CRS-SS+7°). The respective 14° and 7° designations are actually half angles meaning that, a designated 14° divergence means that the light is diverted 14° on each side of the axial direction.

Figure 5:
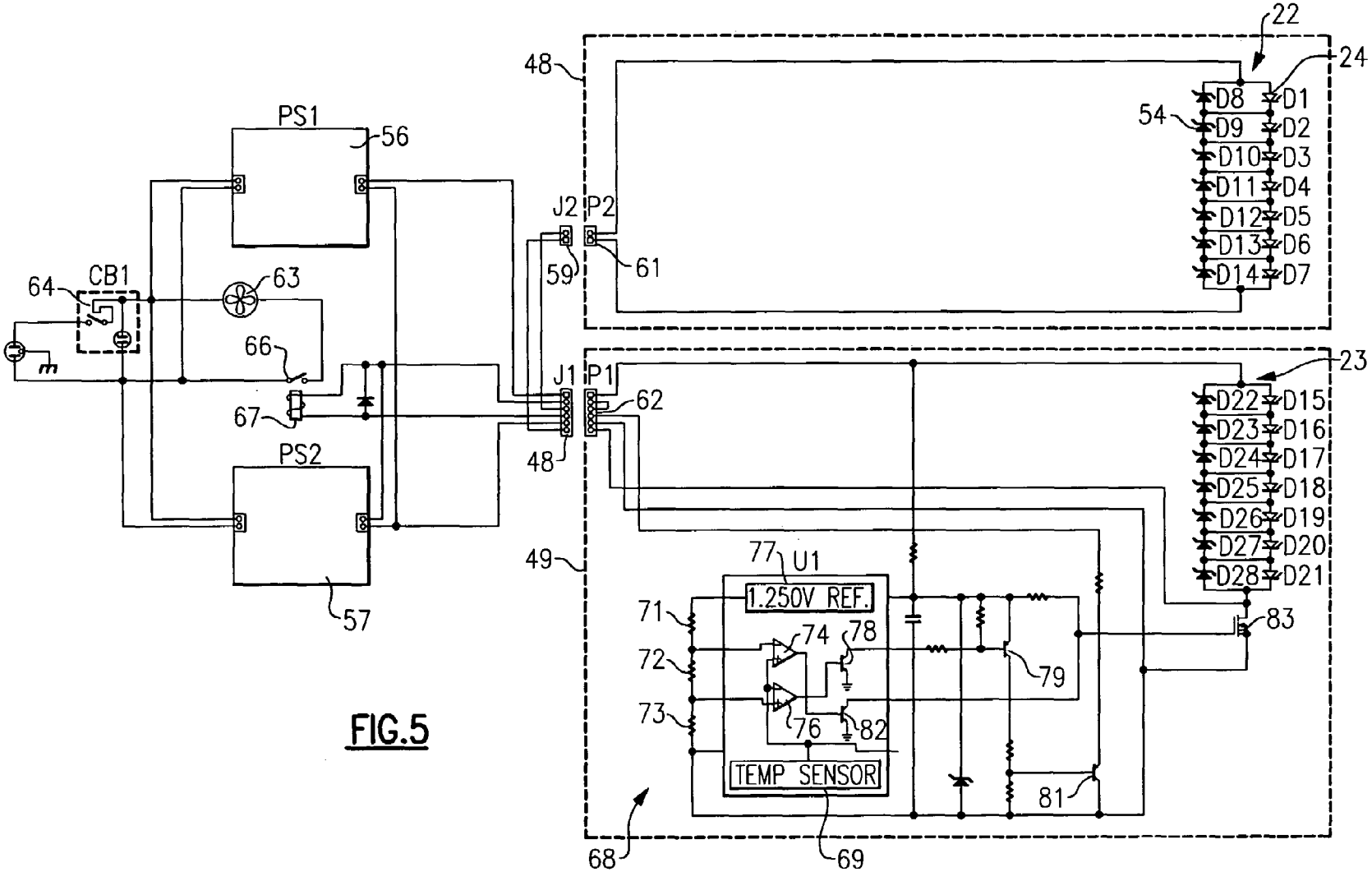
FIG. 5 is a schematic illustration of the electrical circuitry in accordance with the present invention.

Considering now the electrical circuitry, reference is made to FIG. 5.

The two circuit boards 48 and 49 are shown within the dotted lines and include the respective LED columns 22 and 23. Each of the LEDs 24 in those two columns is connected in series with the other LEDs in that column and includes a zener diode 54 connected in parallel therewith. In this way, if one LED goes open, then the rest of the LEDs will not go out because the diode will jump the open condition. In this regard, the LEDs are connected in series so as to obtain a constant current therethrough, a condition which would not exist if they were connected in parallel.

The circuit boards 48 and 49 are individually powered by respective power sources 56 and 57, which are 25 watt supplies with a constant current at 700 milliamps. The output voltage is 18-36 volts DC. Power from the power source 56 flows first to the receptacle 58, then to the receptacle 59 to the header 61 of the circuit board 48. Power to the circuit board 49 passes from the power source 57 to the receptacle 58 and then to the header 62 of the circuit board 49.

Power is provided to the fan 63 through a series-connected circuit breaker 64 and relay contacts 66. The relay contacts close when the relay coil 67 is energized byway of receptacle 58 in a manner to be described more fully hereinafter.

It is recognized that the LEDs 24 generate a reasonable amount of heat which must be dissipated in order to ensure proper operation. The providing of the heat sink 21 to conduct the flow of heat away from the LEDs by way of the bi-metal boards 48 and 49 is one feature that assists in the cooling of the LEDs 24. Other features which are included for this purpose are referred to as the thermal management apparatus as shown at 68 in FIG. 5. It is included on only one of the circuit boards 48 and 49 since it assumed that the conditions surrounding the circuit board column 22 is substantially the same as those conditions surrounding the LED column 23.

Within the thermal management apparatus 68 is included a temperature sensor 69 which senses the temperature of the circuit board 49. As the temperature of the circuit board 49 rises, there are two temperature thresholds that can be progressively reached, triggering first the turning on of the fan 63 and secondly the turning off of the LEDs. The operations which occur during these steps will now be described.

The two thresholds are set by the three resistors 71, 72 and 73, and comparators 74 and 76 are used to implement the response when the thresholds are reached.

If the comparator 76 determines that the heat sink temperature rises above a first threshold set by resistors 72 and 73 and the voltage reference 77, then the comparator output goes high to turn on the transistor 78, which in turn turns on the PNP transistor 79, which in turn turns on the NPN transistor 81 to thereby activate the relay, close the relay switch 66 and turn on the fan 63. If the temperature then drops below the first threshold level, the operation is reversed and the fan is turned off.

If the comparator 74 determines that the circuit board temperature is above a second threshold level it will turn on the transistor 82 which, in turn, will turn off the mosfet 83 to thereby remove power from the LED columns 22 and 23. Again, if the temperature of the circuit board 49 drops below the second threshold level, then the mosfet 83 will again be turned on and power will be resumed to the LEDs.

While the present invention has been particularly shown and described with reference to the preferred mode as illustrated in the drawing, it will be understood by one skilled in the art that various changes in detail may be effected therein without departing from the spirit and scope of the invention as defined by the claims. For example, although the LEDs have been shown to be square shaped, they could be round as well.

We claim:

1. A warehouse dock light of the type having a housing, a lamp assembly, and an interconnecting tube for flexibly supporting the lamp assembly and conducting the flow of cooling air from the housing to the lamp assembly, wherein the lamp assembly comprises:

a plurality of LEDs arranged in the lamp assembly for collectively providing sufficient light for illumination of an area wherein said LEDs are arranged in two adjacent columns and each of said columns includes at least one LED with a wide angle lens and at least one LED with a narrow angle lens.

2. A warehouse dock light as set forth in claim 1 wherein each of said columns includes a plurality of LEDs with wide angle lens.

3. A warehouse dock light as set forth in claim 2 wherein each of said columns includes an LED with a narrow angle lens near its middle, with a plurality of wide angle lens on either side thereof.

4. A warehouse dock light as set forth in claim 1 wherein said columns are each disposed at an angle such that they project at an outward angle from a central axis.

5. A warehouse dock light as set forth in claim 4 wherein said angle is in the range of 4-6°.

6. A warehouse dock light as set forth in claim 5 wherein said angle is 5°.

7. A warehouse dock light as set forth in claim 1 wherein said LEDs are mounted on at least one bi-metal board.

8. A warehouse dock light as set forth in claim 7 wherein said at least one bi-metal board is mounted to a heat sink.

9. A warehouse dock light as set forth in claim 8 wherein said at least one bi-metal board is mounted to a heat sink by way of double sided, heat transfer thermal tape.

10. A warehouse dock light as set forth in claim 7 and including a heat sensor for sensing the temperature of said at least one bi-metal board and circuitry for responsively turning off/on equipment in response thereto.

11. A warehouse dock light as set forth in claim 10 wherein said warehouse dock light includes a device for turning on a fan when said temperature reaches a first predetermined level.

12. A warehouse dock light as set forth in claim 10 wherein said warehouse dock light includes provisions for turning off said LEDs when said sensor senses that the temperature of the at least one bi-metal board has reached a second predetermined level.

13. A warehouse dock light as set forth in claim 1 wherein said plurality of LEDs are electrically connected in series, with each LED having a zener diode electrically connected thereacross.

14. A warehouse dock light comprising:

a base member for mounting adjacent a door opening;

a hollow flexible self-supporting tube connected at one end thereof to said base member and extending through said door opening;

a lamp assembly connected to the other end of said tube, said lamp assembly including the plurality of LEDs for collectively providing sufficient light for illumination of an area;

a fan for providing a flow of air through said tube to said lamp assembly; and a power source electrically connected to said LEDs wherein said LEDs are arranged in two adjacent columns and each of said columns includes at least one LED with a wide angle lens and at least one LED with a narrow angle lens.

15. A warehouse dock light as set forth in claim 14 wherein each of said columns includes a plurality of LEDs with wide angle lens.

16. A warehouse dock light as set forth in claim 15 wherein each of said columns includes an LED with a narrow angle lens near its middle, with a plurality of wide angle lens on either side thereof.

17. A warehouse dock light as set forth in claim 14 wherein said columns are each disposed at an angle such that they project at an outward angle from a central axis.

18. A warehouse dock light as set forth in claim 17 wherein said angle is in the range of 4-6°.

19. A warehouse dock light as set forth in claim 18 wherein said angle is 5°.

20. A warehouse dock light as set forth in claim 14 wherein said LEDs are mounted on at least one bi-metal board.

21. A warehouse dock light as set forth in claim 20 wherein said at least one bi-metal board is mounted to a heat sink.

22. A warehouse dock light as set forth in claim 21 wherein said at least one bi-metal board is mounted to a heat sink by way of double sided, heat transfer thermal tape.

23. A warehouse dock light as set forth in claim 20 and including a heat sensor for sensing the temperature of said at least one bi-metal board and circuitry for responsively turning off/on equipment in response thereto.

24. A warehouse dock light as set forth in claim 23 wherein said electrical components includes a device for turning on said fan when said temperature reaches a first predetermined level.

25. A warehouse dock light as set forth in claim 23 wherein said electronic components include provisions for turning off said LEDs when said sensor senses that the temperature of the at least one bi-metal board has reached a second predetermined level.

26. A warehouse dock light as set forth in claim 16 wherein said plurality of LEDs are electrically connected in series, with each LED having a zener diode electrically connected thereacross.

* * * * *